United States Patent [19]

Phillips

[11] Patent Number: 4,790,037

[45] Date of Patent: Dec. 13, 1988

[54] SWIMMING POOL COVER ASSEMBLY

[75] Inventor: Dwaine Phillips, Oklahoma City, Okla.

[73] Assignee: Air-Lok Pool Covers, Inc., Oklahoma City, Okla.

[21] Appl. No.: 49,734

[22] Filed: May 13, 1987

[51] Int. Cl.[4] ..... E04H 3/19

[52] U.S. Cl. ..... 4/499; 52/222

[58] Field of Search ..... 4/496, 498–506; 160/382, 383, 391, 392; 24/359, 360, 362; 52/410, 698, 2 C, 222; 411/431; 220/232

[56] References Cited

U.S. PATENT DOCUMENTS

| | | | |
|---|---|---|---|
| 3,103,083 | 9/1963 | Seeger | 220/232 |
| 3,231,644 | 1/1966 | Ming-Yang Chang | 52/2 E |
| 3,608,099 | 9/1971 | Wall | 4/503 |
| 3,747,131 | 7/1973 | Koliomichalis | 4/503 |
| 3,810,262 | 5/1974 | Strand | 52/2 D |
| 3,918,221 | 11/1975 | Benjamin | 52/2 D |
| 4,011,607 | 3/1977 | Davidoff | 4/503 |
| 4,107,826 | 8/1978 | Tysdal | 24/460 |
| 4,122,561 | 10/1978 | Barr | 4/499 |
| 4,189,880 | 2/1980 | Ballin | 160/392 |
| 4,566,236 | 1/1986 | Pound | 24/460 |
| 4,658,558 | 4/1987 | Verble | 52/410 |

FOREIGN PATENT DOCUMENTS

| | | | |
|---|---|---|---|
| 0625463 | 9/1961 | Italy | 160/392 |
| 1037236 | 7/1966 | United Kingdom | 160/392 |

*Primary Examiner*—Charles E. Phillips

*Attorney, Agent, or Firm*—Bill D. McCarthy

[57] ABSTRACT

A swimming pool cover assembly is provided which can easily be installed and removed, and which is adapted to be supported above the surface of the pool without bulky reinforcing or structural members. The swimming pool cover assembly includes an air impervious cover member having dimensions greater than the dimensions of the pool so as to span the pool, an anchor assembly disposed about the perimeter of the pool for securing the cover member over the pool and forming fluid-tight seal therebetween, and a blower assembly for supplying a sufficient volume of air so that a cushion of air is formed between the cover member and the water in the pool for maintaining the cover member in an elevated positioned relative to the surface of the water in the pool.

6 Claims, 1 Drawing Sheet

SWIMMING POOL COVER ASSEMBLY

BACKGROUND OF THE INVENTION

1. Field of the Invention

The present invention relates to swimming pool cover assemblies, and more particularly, but not by way of limitation, to a swimming pool cover assembly positionable over a pool such that a cushion of air is formed therebetween for supporting the cover assembly in an elevated position relative to water in the pool.

2. Brief Description of the Prior Art

In recent years the number of swimming pools installed in residential areas has substantially increased. Preventive maintenance on such pools, especially during winter-time or when the pool is not in use, is often a time-consuming and burdensome chore for the homeowner. Swimming pool covers to winterize or prevent trash and debris from entering the pool have heretofore been proposed by the prior art. However, such covers are typically bulky, difficult to install and remove, as well as unsightly in appearance.

SUMMARY OF THE INVENTION

According to the present invention a swimming pool cover assembly is provided which can be readily installed and removed; and which is supported above the surface of the water in the pool without bulky reinforcing or structural members. Broadly, the swimming pool cover assembly of the present invention comprises: an air impervious cover member having dimensions greater than the dimensions of the pool so as to span the pool; an anchor assembly disposed about the perimeter of the pool for securing the cover member over the pool; and a blower assembly for supplying a sufficient volume of air to provide a cushion of air between the water in the pool and the cover member. The cover member is provided with an inlet opening in one end thereof so that air from the blower assembly can be effectively directed under the cover member and between the surface of the water so that the cover member is elevated relative to the surface of the water in the pool.

An object of the present invention is to provide a light weight, durable cover assembly for a swimming pool.

Another object of the present invention, while achieving the before-stated object, is to provide a cover assembly for a swimming pool which can be easily assembled in a spanning position or removed when the pool is in use.

Another object of the present invention, while achieving the before-stated objects, is to provide a durable swimming pool cover assembly which is economical to manufacture, attractive in appearance, and which is effective in preventing debris and trash from entering the pool.

Other objects, advantages and features of the present invention will become clear when the following descriptions is read in conjunction with the accompanying drawings and the appended claims.

DESCRIPTION

Figure 1:
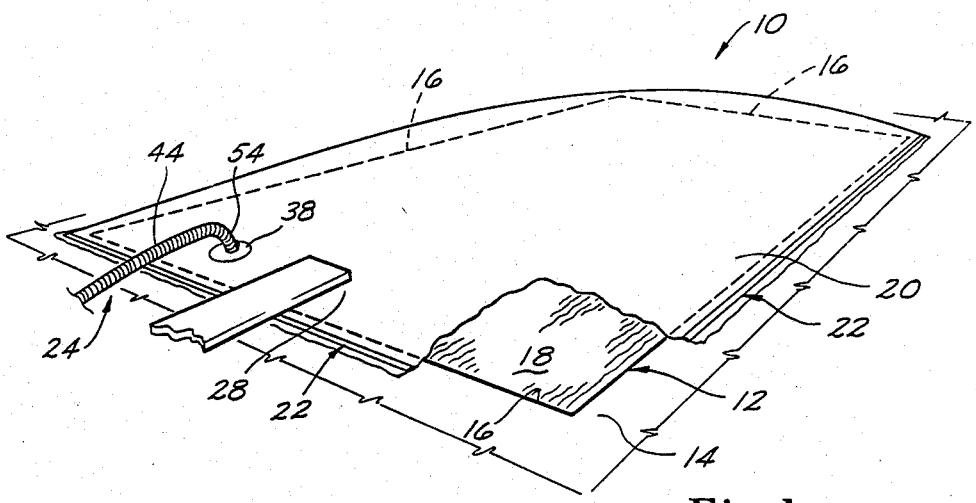
FIG. 1 is a partially cutaway, perspective view of a pool cover assembly of the present invention wherein the cover assembly is disposed to span and cover a swimming pool.

Referring now to the drawings, and more particularly to FIG. 1, shown therein is a swimming pool cover assembly 10 of the present invention positioned to span and cover a swimming pool 12. The swimming pool 12 is of conventional construction and includes a deck 14 extending about a peripheral edge 16 of the pool 12. The pool 12 is filled with water 18 in the customary manner for use of the pool 12.

The cover assembly 10 comprises an air impervious cover member 20, an anchor assembly 22 for securing the cover member 20 over the pool 12, and a blower assembly 24 for providing a cushion of air between the surface of the water 18 of the pool 12 and the cover member 20. The cover member 20 is fabricated of any suitable air impermeable material which is flexible, light in weight, durable and resistant to solar heat and the sun's rays. Typical of such materials which are commercially available are polymeric materials, such as polyethylene, polypropylene, and polymeric coated textile materials.

The cover member 20, which is adapted to span the pool 12, has dimensions greater than the dimensions of the pool 12 so such that when the cover member 20 is secured to the anchor assembly 22, and a supply of air is provided between the surface of the water 18 in the pool 12 and the cover member 20, the cushion of air causes the cover member 20 to be elevated relative to the surface of the water 18 in the pool 12 (substantially as shown in FIG. 1). In order to form the cushion of air between the cover member 20 and the surface of the water 18 in the pool 12, the cover member 20 is provided with an inlet opening 26 in one end portion 28 thereof. Thus, upon attachment of a hose connector member 30 to the cover member 20 a fluid flow passageway is defined through the cover member 20 by the hose connector member 30 and the inlet opening 26. That is, the inlet opening 26 and the hose connector 30 cooperate to establish fluid communication between the blower assembly 24 and the air space between the cover member 20 and the surface of the water 18 in the pool 12.

Figure 2:
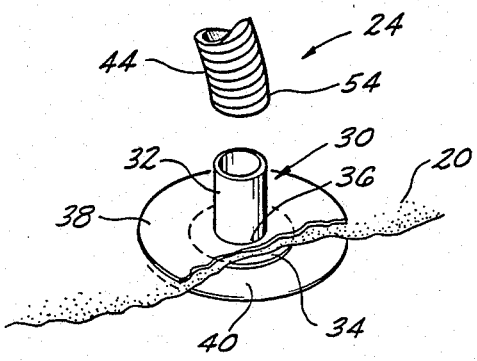
FIG. 2 is a fragmentary, partially cutaway view of one side of a cover member of the pool cover assembly illustrating a hose connector secured thereto.
Figure 3:
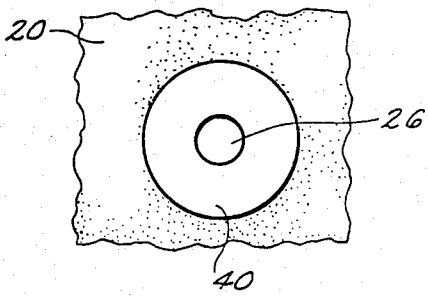
FIG. 3 is a fragmentary view of a second side of the cover member showing a reinforcing member for securing the hose connector.
Figure 4:
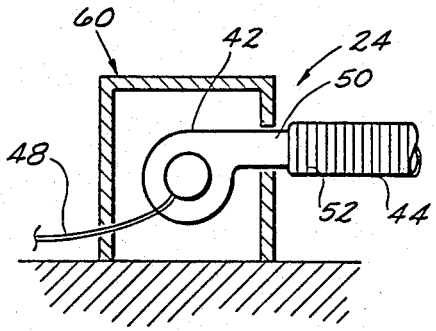
FIG. 4 is a cross-sectional schematic view of a support member for supporting a blower of the pool cover assembly of the present invention.

Referring now to FIGS. 2 and 3, the hose connector member 30 comprises a cylindrically-shaped body member 32 and a base member 34. The base member 34 is connected to one end 36 of the body member 32 such that the body member 32 extends substantially normal to the plane of the base member 34. Thus, the base member 34 can be secured to the portion of the cover member 20 defining the inlet opening 26. Because of stress that may be applied to the portion of the cover member 20 adjacent the inlet opening 26 as a result of connection of the hose connector member 30 and the blower assembly 24, the cover assembly further comprises reinforcing members 38 and 40.

The reinforcing members 38 and 40 may be fabricated of the same material as the cover member 20; or the reinforcing members 38 and 40 may be fabricated of different materials provided that the combination of materials employed in the fabrication of the cover member 20 and the reinforcing members 38 and 40 have sufficient strength to reinforce the cover member 20 about the inlet opening 26. Further, the reinforcing members 38 and 40 can be connected to cover member 20, and if desired, the base member 34 of the hose connector member 30, by any suitable means such as adhesives, sewing and the like.

In order to form the cushion of air between the cover member 20 and the surface of the water 18 of the pool 12 (when the cover member 20 is disposed in a covering relationship with the pool 12 and secured in place by the anchor assembly 22) the blower assembly 24 is operably connected to the body member 32 of the hose connector member 30. The blower assembly 24 comprises a blower 42 and a flexible hose 44. The blower assembly 42 is connected to a power source (not shown) by electrical lead 48. The blower 42 is of conventional construction and includes a discharge nozzle 50. Such blowers are commercially available items. The only requirement in the selection of the blower 42 is that the blower 42 has sufficient capacity to deliver the required volume of air to form the air cushion between the surface of the water 18 of the pool 12 and the cover member 20 so that the cover member 20 can be elevated above the surface of the water in the pool 12 substantially as shown in FIG. 1.

The flexible hose 44, which is also a commercially available item, is characterized as having a first end 52 and an opposed second end 54. The first end 52 of the hose 44 is disposed over and connected to the discharge nozzle 50 of the blower 42; and the second end 54 of the hose 44 is disposed over and connected to the body member 32 of the hose connector 30 via a second end 56 of the body member 32 such that fluid tight seals are formed therebetween. Thus, in an assembled position, fluid communication is established between the blower 42 and the inlet opening 26 in the cover member 20 via the hose 44 and the hose connector 30. If desired a pair of conventional clamp members (not shown) can be employed to secure the first end 52 of the hose to the discharge nozzle 50 of the blower 42, and to secure the second end 54 of the hose 44 to body member 32 of the hose connector member 30.

To secure the blower 42 in a stable position on the deck 14 at a predetermined location relative to the inlet opening 26 in the cover member 20, the blower assembly 24 further comprises a blower housing or support 60. Any suitable structure can be employed as the blower housing 60 provided such structure secures the blower 42 in a stable position, permits connection of the first end 52 of the hose 44 to the discharge nozzle 50 of the blower 42, and desirably protects the blower 42 from the elements. In addition, the blower housing 60 can be fabricated so as to be a stationary structure; or the blower housing 60 can be fabricated as a portable structure so as to permit removal of the blower housing 60 from the pool area when not in use.

The anchor assembly 22 of the pool cover assembly 10 is disposed about the perimeter of the pool 12 and secured to deck 14. The anchor is constructed so as to engage an edge portion of the cover member 20 so that a fluid-tight seal can be formed therebetween when the cover member 20 is positioned in a covering position relative to the pool 12.

Figure 5:
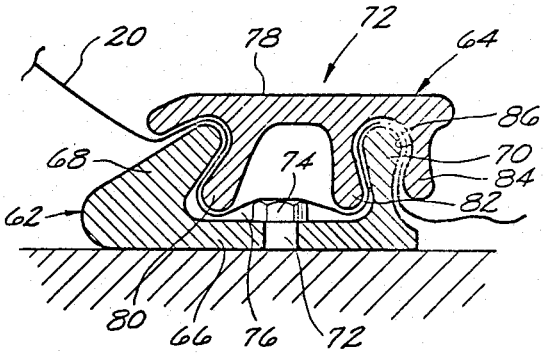
FIG. 5 is a cross-sectional side elevational view of an anchor assembly of the pool cover assembly of the present invention for securing the cover member about the periphery of a pool.

Referring now to FIG. 5, the anchor assembly 22 comprises a stationary backup element 62 and a cover locking element 64. The backup element 62 is fabricated generally as segments which are abutted to form a continuous strip about the perimeter of the swimming pool 12 (see FIG. 1). The backup element 62, which is secured to the deck 14, comprises a securement plate 66, and a pair of spatially disposed tab engaging members 68, 70 extending therefrom substantially as shown. The securement plate 66 is provided with a plurality of spatially disposed apertures, such as aperture 72, adapted to receive a fastening or connecting element, such as a screw 74, for securing the backup element 62 to the deck 14 at the desired position about the peripheral edge 16 of the swimming pool 12.

The securement plate 66 and the tab engaging members 68, 70 cooperate to form a locking cavity 76 adapted to receive the cover locking element 64. That is, when the cover locking element 64 is disposed in the locking cavity 76, the cover locking element 64 is secured in locking engagement with the backup element 62 via the tab engaging members 68, 70.

Thus, when an edge portion of the cover member 20 is positioned across the locking cavity 76 of the backup element 62 and the cover locking element 64 is connected to the backup element 62, the cover member 20 is secured to the anchor assembly 22 such that a substantially fluid-tight seal is formed therebetween.

The cover locking element 64, which is connectable to the backup element 62 so as to secure the cover member 20, comprises a cover plate 78 having a pair of spatially disposed locking tabs 80 and 82 extending therefrom. The locking tabs 80 and 82 are angularly disposed from one another in a diverging direction so as to be positionable within the locking cavity 76 of the backup element 62 for locking engagement with the tab engaging members 68 and 70. Desirably, a third locking or stabilizing tab 84 is spatially disposed from the locking tab 82 such that the distal ends of the locking tabs 82 and 84 converge and define a tab receiving cavity 86 adapted to receive the tab engaging element 70 of the backup element 62 substantially as shown. The edge or distal ends of the tab engaging members 68, 70 of the backup element 62 and the edges or distal ends of the locking tabs 80, 82 and 84 of the cover locking element 64 are rounded to avoid sharp edges that would tear or weaken the cover member 20 when secured to the anchor assembly 22. Further, when the cover locking element 64 is connected to the backup element 62, the cover plate 78 of the cover locking element 64 forms a top surface for the anchor assembly 22. The design and construction of the backup element 62 and the cover locking element 64 are such that ,it in an assembled position the cover plate 78 functions as a supporting surface when one steps on the anchor assembly 22.

While one embodiment of the anchor assembly 22 for connecting the cover member 20 to the deck 14 surrounding the swimming pool 12 has been illustrated with reference to FIG. 5, it should be understood that similar type anchor assemblies can be employed. For example, one such anchor assembly which can be employed to secure the cover member 20 in a spanning position over the swimming pool 12 is a commercially available item marketed by Agra Tech Inc. of Pittsburg, Calif. under the trademark "Agra Lock", and disclosed in U.S. Pat. No. 4,566,236.

In order to assemble the swimming pool cover assembly 10 of the present invention the backup elements 62 of the anchor assembly 22 are positioned about the peripheral edge 16 of the swimming pool 12 and secured to the deck 14 by a plurality of screws, such as the screw 74. The blower assembly 24, including the blower housing or support 60 and the blower 42, is assembled and secured near one end of the swimming pool 12. The cover member 20, which has desirably been fabricated with the hose connector member 30 reinforced about the inlet opening 26 in the cover member 20, is attached to the second end 54 of the flexible hose 44. After connection of the flexible hose 44 to the hose connector member 30 the cover member 20 is positioned over the pool and the edges thereof connected to the anchor assembly 22. Once the cover member 20 has been supposed over the swimming pool 12 and secured to the anchor assembly 22, the first end 52 of the flexible hose is connected to the discharge nozzle 50 of the blower 42. Thereafter, upon activation of the blower 42 air is directed through the flexible hose 44, the hose connector member 30 and the inlet opening 26 so that a sufficient volume of air is delivered between the surface of the water in the swimming pool 12 and the cover member 20 to provide a cushion of air between the water in the pool 12 and the cover member 20. The air cushion supports the cover member 20 in an elevated position relative to the surface of the water 18 of the pool 12, while at the same time the cover member 20 spans the pool to prevent debris and trash from entering the swimming pool 12.

In order to disassemble the cover assembly 10 the flexible hose 44 is disconnected from the discharge nozzle 50 of the blower 42, and if desired, from the hose connector member 30. Thereafter, the cover locking element 64 is disengaged from the backup element 62 so that the cover member 20 can be removed therefrom. The cover member 20 is then removed from its covering relationship with the swimming pool 12 for storage and the like. If desired, the blower housing or support 60 and the blower 42 can likewise be removed from the pool area for storing.

It is clear that the present invention is well adapted to carry out the objects and to attain the ends and advantages mentioned as well as those inherent therein. While presently preferred embodiments have been described for purposes of this disclosure, numerous changes may be made which will readily suggest themselves to those skilled in the art and which are encompassed within the spirit of the invention disclosed and as defined in the appended claims.

What is claimed is:

1. A swimming pool cover assembly for protecting a swimming pool from debris and weather, the swimming pool cover assembly comprising:

a. an air impervious cover member adapted to span the pool, the cover member having an inlet opening in one end portion thereof and dimensions greater than the dimensions of the pool;

b. anchor means disposed about the perimeter of the pool for securing the cover member over the pool and for forming a substantially air-tight seal with the cover member, the anchor means comprising:

(1) a stationary backup element secured to the deck perimeter about the pool, the backup element having a securement plate and a pair of spatially disposed tab engaging members extending form the securement plate and cooperating with the securement plate to form a locking cavity therebetween;

(2) a cover locking element having a cover plate and a pair of spatially disposed locking tabs extending therefrom and angularly disposed in a diverging direction, the locking tabs being positionable within the locking cavity for locking engagement with the tab engaging members of the backup element so that when a portion of the cover member is positioned therebetween and the cover locking element is disposed within the locking cavity a substantially fluid-tight seal is formed therebetween, the cover locking element further comprising a third locking tab extending therefrom and spatially disposed from one of the other locking tabs, the third locking tab and the adjacent locking tab converging so as to define a tab receiving a cavity adapted to receive one of the tab engaging members of the backup element; and (3) connecting means for connecting the back up element to the deck in close proximity to an edge of the pool;

c. blower means connected to the cover member via the inlet opening for producing a sufficient volume of air to provide a cushion of air between water in the pool and the cover member and to support the cover member in an elevated position relative to the surface of the pool, the blower means comprising:

(1) an air blower having a discharge nozzle; and (2) a flexible hose having a first end portion and a second end portion, the first end portion connected to the discharge nozzle of the air blower and the second end portion connected to the cover member such that the hose is in fluid communication with the inlet opening of the cover member and a substantially air-tight seal is formed therebetween, and d. reinforcing means connected to the cover member about the inlet opening for reinforcing the cover member adjacent to the inlet opening.

2. A swimming pool cover assembly comprising a. an air impervious cover member adapted to span the pool, the cover member having an inlet opening in one end portion thereof and dimensions greater than the dimensions of the pool;

b. anchor means disposed about the perimeter of the pool for securing the cover member over the pool and for forming a substantially air-tight seal with the cover member, the anchor means comprising:

(1) a stationary backup element secured to the deck perimeter about the pool, the backup element having a securement plate and a pair of spatially disposed tab engaging members extending from the securement plate and cooperating with the securement plate to form a locking cavity therebetween; and (2) a cover locking element having a cover plate and a pair of spatially disposed locking tabs extending therefrom and angularly disposed in a diverging direction and positionable within the locking cavity for locking engagement with the tab engaging members of the backup element so that when a portion of the cover member is positioned therebetween and the locking element is disposed within the cover locking cavity a substantially fluid-tight seal is formed therebetween, the cover locking element further comprising a third locking tab extending from the cover plate and spatially disposed from one of the locking tabs, the third locking tab and the adjacently disposed locking tab cooperating to define a tab receiving cavity adapted to receive one of the tab engaging members of the backup element; and c. blower means connected to the cover member via the inlet opening for producing a sufficient volume of air to provide a cushion of air between water in the pool and the cover member and to support the cover member in an elevated position relative to the surface of the pool.

3. The swimming pool cover assembly of claim 2 wherein the blower means comprises:

an air blower having a discharge nozzle; and a flexible hose having a first end portion and a second end portion, the first end portion connected to the discharge nozzle of the air blower and the second end portion connected to the cover member such that the hose is in fluid communication with the inlet opening of the cover member and a substantially air-tight seal is formed therebetween.

4. The swimming pool cover assembly of claim 3 wherein the blower means further comprises:

support means for supporting the air blower at a desired location relative to the air inlet opening and the pool.

5. The swimming pool cover assembly of claim 4 further comprising:

hose connector means for connecting the second end portion of the hose to the cover member, the hose connector means having a substantially cylindrically shape body member and a base member connected to one end thereof, the base member being disposed adjacent the cover member such that the body member extends substantially normal to the plane of the base member, the body member and the base member having a passageway extensive therethrough openly communicating with the inlet opening of the cover member.

6. The swimming pool cover assembly of claim 2 further comprising:

reinforcing means connected to the cover member about the inlet opening for reinforcing the cover member adjacent the inlet opening.

* * * * *

UNITED STATES PATENT AND TRADEMARK OFFICE

CERTIFICATE OF CORRECTION

PATENT NO. : 4,790,037

DATED : Dec. 13, 1988

INVENTOR(S) : Dwaine Phillips

It is certified that error appears in the above-identified patent and that said Letters Patent is hereby corrected as shown below:

Cover Sheet - [57] Abstract, line 14, the word "positioned" should read --position--. In column 1, lines 60 and 61, the word "descriptions" should read --description--. In column 4, line 57, the words "that ,it in" should read --that in--. In column 6, line 1, the "form" should read --from--.

Signed and Sealed this

Twentieth Day of June, 1989

*Attest:*

*Attesting Officer*

DONALD J. QUIGG

*Commissioner of Patents and Trademarks*